United States Patent [19]

Palmer et al.

[11] Patent Number: 4,916,999

[45] Date of Patent: Apr. 17, 1990

[54] OFFSHORE LAUNCHING SYSTEM

[75] Inventors: C. R. Palmer; Robert A. Keller, both of Houston; Daniel F. McNease, Spring, all of Tex.

[73] Assignee: Rowan Companies, Inc., Houston, Tex.

[21] Appl. No.: 263,625

[22] Filed: Oct. 27, 1988

[51] Int. Cl.[4] ..... F41F 3/04

[52] U.S. Cl. ..... 89/1.815; 89/1.8

[58] Field of Search ..... 89/1.809, 1.810, 1.802, 89/1.815; 114/259, 260

[56] References Cited

U.S. PATENT DOCUMENTS

| | | | |
|---|---|---|---|
| 3,002,428 | 10/1961 | Johnstone | 89/1.802 |
| 3,074,321 | 1/1963 | Draim et al. | 89/1.809 |
| 3,122,057 | 2/1964 | Kubit | 89/1.810 |
| 3,135,162 | 6/1964 | Kamalian | 89/1.810 |
| 3,245,318 | 4/1966 | Finkelstein et al. | 89/1.809 |
| 3,373,657 | 3/1968 | Guin | 89/1.810 |
| 4,724,738 | 2/1988 | Johnson | 89/1.809 |
| 4,747,334 | 5/1988 | Kuriiwa | 89/1.802 |

FOREIGN PATENT DOCUMENTS 1256549 12/1967 Fed. Rep. of Germany .

OTHER PUBLICATIONS

R. G. LeTourneau, Inc., "Offshore Launch Facilities Study", Proposal to Marshall Space Flight Center, RFQ TP 88-296, 2 Jun. 1961.

"Sea Launch Studied for Space Vehicles", Booda, Aviation Week, Dec. 12, 1960, pp. 69-79.

Woutat, "Star Wars Goes to Sea", Los Angeles Times, Jul. 6, 1988, pp. 1, 13.

Fletcher, "Offshore Rigs Could Become Rocket Launchers", Houston Post, Feb. 14, 1988, p. 10D.

"Rowan Gorilla", Product Brochure, Published by Rowan Companies, Inc., Houston, Tex., (pre-1988).

*Primary Examiner*—David H. Brown

*Attorney, Agent, or Firm*—Arnold, White & Durkee

[57] ABSTRACT

A jack-up type of offshore oil-drilling platform is adapted for rocket launching, wherein the rocket is assembled on a mobile launch pad in a protected on-shore facility then loaded onto the floating jack-up barge for transport to a launch site miles offshore. The barge is jacked up to create a stable, sea-bottom supported structure; a particular feature is the used of a movable cantilever structure on which the rocket and its supporting pad are loaded while in the on-shore facility, then this structure is moved to a central location on the barge, the barge is floated, and the floating barge is towed to the launch site. At the launch site the structure is moved back to a cantilevered position for launch. In this manner the exhaust gasses from the rocket motors can be directed harmlessly into the sea.

28 Claims, 6 Drawing Sheets

OFFSHORE LAUNCHING SYSTEM

BACKGROUND OF THE INVENTION

This invention relates to offshore launching of satellites and other payloads, and more particularly to a method using offshore oil-drilling type of equipment for assembling, transporting and launching of missiles or rockets.

The possibility of launching rocket vehicles for placing payloads such as communications satellites or the like into earth orbit from offshore locations has long been considered, and various investigations have been made of facilities for offshore launch. Land-based launch facilities are of course preferred because of the accessibility and ease of moving and supporting large and heavy equipment around the launch site, stability of the launch site, less severity of weather problems, etc. A land-based launch site is usually near the shore, however, so the trajectory can be over water instead of over populated areas. The availability of large, essentially undeveloped coastal land for these purposes is very limited. Even when suitable land is available, other concerns such as use of corrosive chemicals in environmentally-sensitive areas, noise pollution, air pollution, preservation of historic sites, and the like, have prevented use of such land for launching facilities.

Due to these problems with on-shore launch, investigation of methods and equipment for offshore launch has been an on-going endeavor. For example, R. G. LeTourneau, Inc. prepared a detailed study for the George C. Marshall Space Flight Center, entitled "Offshore Launch Facilities Study", responding to RFP No. TP 88-296, dated 2 June 1961, which proposed the use of a launch platform similar to the sea-bottom-supported, self-elevating platforms employed for offshore oil drilling and production (this type of platform is commonly referred to as a "jack-up" rig). An equatorial launch site off the coast of Kenya used a sea-bottom mounted platform for launch of a Scout rocket in 1967 by NASA and the Italian Government; this was called the San Marco Range. Also, various floating vessels have been proposed such as that seen in U.S. Pat. No. 4,747,334 where a floating-island launch pad is shown using a semi-submersible hull for transporting the launch pad. None of these prior proposals have resulted in construction of viable launch facilities, however, due to expected problems in stability of the vehicles during assembly of the space vehicles or rockets, sensitivity to weather and seas, cost of support vessels needed, and the like.

It is therefore the principal object of this invention to provide an improved method for offshore launching of rockets or space vehicles. Another object is to provide improved equipment and facilities for space vehicle launching which will be of greater stability, lower cost, and/or environmentally acceptability. Still another object is to provide an offshore launch system in which there is no need to transfer a rocket vehicle at sea from a vessel to another vessel or structure, or no need for critical docking or mating of vessels at sea to transfer a rocket. A further object is to provide equipment and methods for offshore launch which will be more suitable (compared to semi-submersible platforms) for handling large and relatively fragile rocket engines, rocket fuel containers and space vehicles. An additional object is to provide an offshore launch system and facility that will allow flexibility in launch location, especially to permit selection of polar or equatorial orbits, yet permitting the use of only one on-shore support arrangement and one offshore platform, resulting in economy and also in less time needed for changing configurations. Similarly, an important object is to provide a "universal" type of offshore launch facility, i.e., one capable of launching many different types and sizes of rockets without major reconstruction; for example, a mobile pad for supporting the assembled rocket may be of various sizes depending upon the size and type of rocket being launched, but the remaining structures used in the launching system would all stay the same. It is an overall objective to provide an economically viable offshore launch facility and method.

SUMMARY OF THE INVENTION

In accordance with one embodiment of the invention, a sea-bottom-supported, self-elevating ("jack-up") type of offshore oil-drilling platform is adapted for rocket launching. The missile or rocket can be assembled in a protected on-shore facility while on a movable pad or "mobile launch platform" then picked up by use of a cantilevered structure on the jack-up barge or platform while the barge is in a stationary position adjacent the on-shore assembly building, with legs on-bottom. After the rocket and pad are in place, the barge is refloated and transported to a launch site miles offshore where the barge is then jacked up using the self-elevating legs to create a stable, sea-bottom supported structure for the launch. A particular feature of one embodiment is the use of a horizontally-slidable cantilever structure on which the rocket and mobile launch pad are mounted while in the on-shore facility; this cantilever structure is moved to a central location on the barge before the barge is floated for towing to the launch site. At the launch site, after jack-up, the structure holding the rocket is moved back outboard to a cantilevered position for launch. The pad and cantilevered structure may have an opening extending to the waterline, so in this manner the exhaust gasses from the rocket motors can be directed harmlessly into the sea. For large-sized, heavier rocket vehicles, the cantilever structure may be maintained in the central location on the barge for launch, instead of being moved to the outboard position, in which case the opening for the exhaust plume would have to extend through the barge itself.

BRIEF DESCRIPTION OF THE DRAWINGS

The features believed characteristic of the invention are set forth in the appended claims. The invention itself, however, as well as other features and advantages thereof, may best be understood by reference to the detailed description of a specific embodiment which follows, when read in conjunction with the accompanying drawings, wherein:

DETAILED DESCRIPTION OF A SPECIFIC EMBODIMENT

Figure 1:
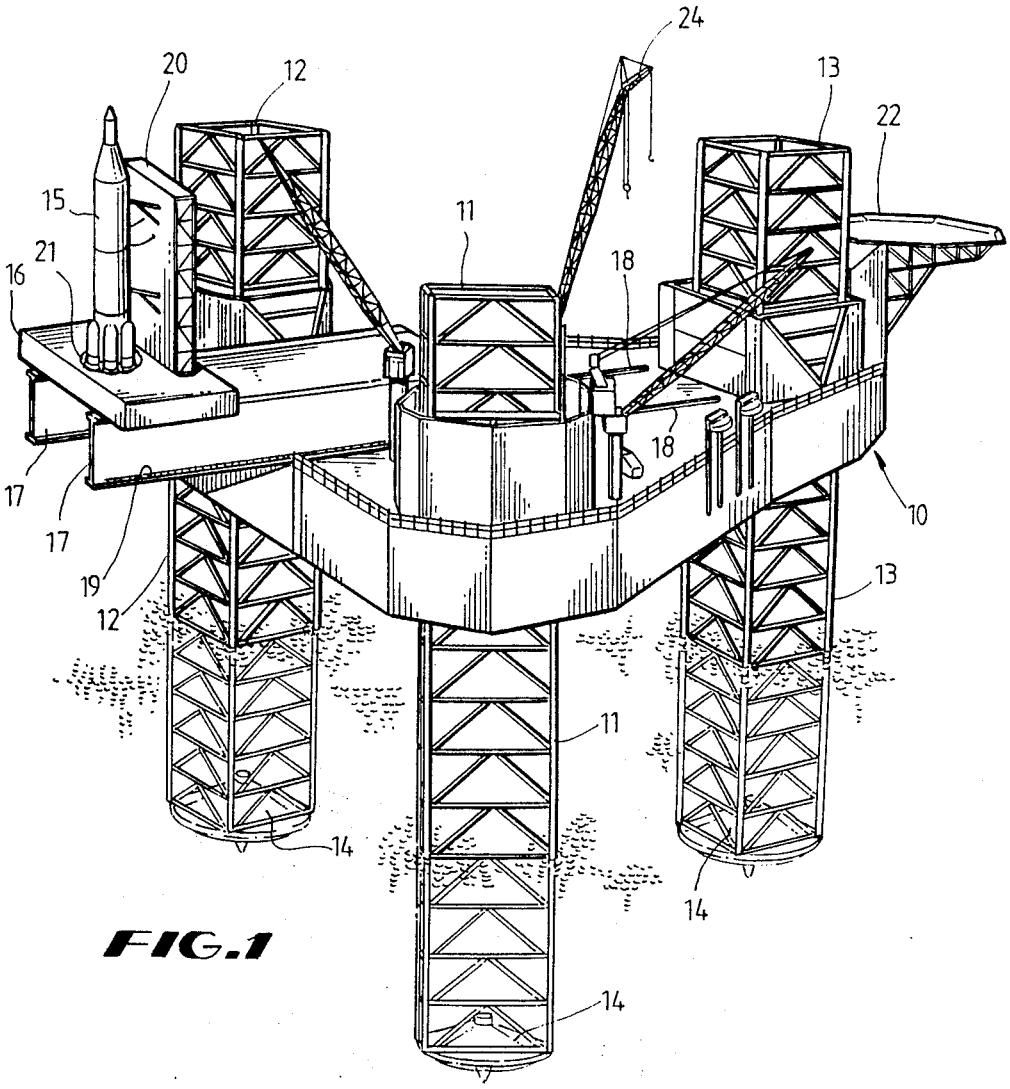
FIG. 1 is a pictorial view of a jack-up type of offshore launch platform according to one embodiment of the invention.

With reference to FIG. 1, a pictorial view of a launching platform, employing a jack-up type of rig similar to that which has been used for oil drilling, is shown according to an example of an embodiment of the invention. This same system is seen in top and side elevation views in FIGS. 2 and 3. This launching platform is structurally similar to the so-called "Gorilla" drilling units owned and operated by Rowan companies, Inc., Houston, Texas and constructed by Marathon LeTourneau Offshore Company, Houston, Texas. This launching platform seen in the figures includes a floating hull 10 of three-sided shape having three legs 11, 12 and 13; the legs are vertically movable between an upper position when the hull is floating and a lower position where spuds 14 at the lower ends of the legs engage the sea bottom and the hull 10 is jacked up to clear the water. The legs 11, 12 and 13 are moved up or down relative to the hull 10 by electromechanical rack-and-pinion mechanisms. The spuds 14 are hollow tanks which may be filled with seawater or pumped free as variable ballast. Seawater may be pumped through water jets on the underside of the spuds 14 to clear away silt so that a firm base is provided when the hull is jacked up. Although the size of the launching platform constructed will depend upon the size of the rocket to be launched, it is important to note the dimensions of one example of a counterpart oil-drilling rig of this type in commercial use; the hull 10 is almost 300 feet in length and in width, the legs 11, 12 and 13 have a total height of 600 feet (allowing the hull to be lifted free of the water in water depth of 450 feet), and the spuds 14 are about 65 feet in diameter. Larger units can be constructed for launching heavier rocket vehicles and/or for use in greater water depth; without redesign of the jack-up mechanism the legs can be as much as 750 feet in length (allowing operation in water depth up to 600 feet) and the hull 10 can have another 100 feet added to its lateral dimensions (to accommodate rocket vehicles of up to 20-million pounds in weight). The watertight hull 10, when in the floating condition, can be moved by tugboats at about 7 knots when in transit to a launch site, and the jack-up operation can be accomplished at a race of about 90 feet per hour. The hull 10 draws about 15-feet of water when in the floating condition with the legs in their highest position. The size of the hull 10 and its configuration are such that roll is minimized even in high seas, when in the floating condition; compared to semi-submersible drilling platforms, this rig exhibits much less roll in heavy seas because the righting moment is much larger—a semi-submersible unit has a low righting moment because of the configuration at the waterline. Roll of the hull 10 when in the floating condition is further reduced by installation of a commercially-available damping skirt such as the so-called "Slo-Rol" skirt.

Figure 2:
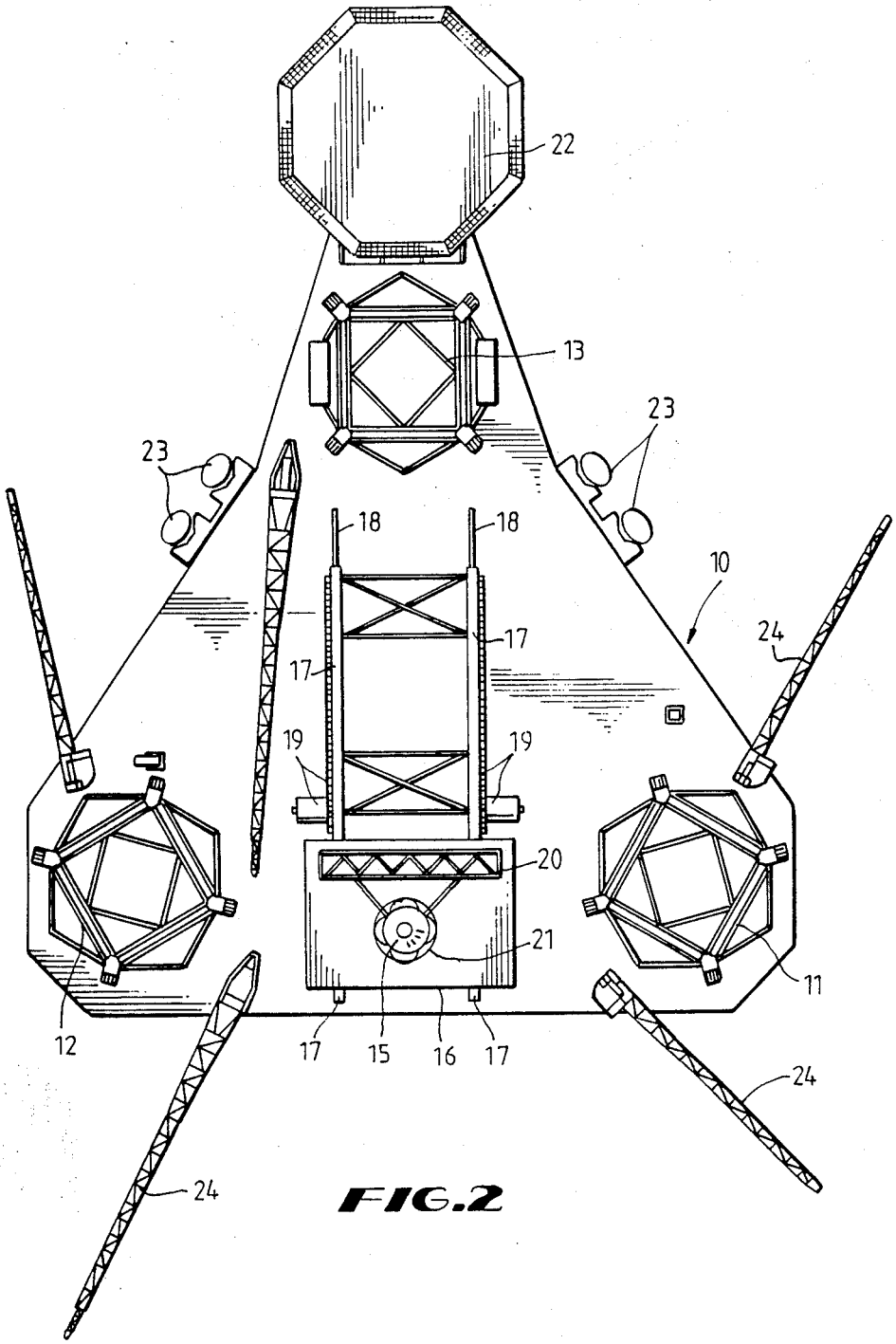
FIG. 2 is a top view of the system of FIG. 1 in the floating condition with the rocket in the central location as when the barge is transporting the rocket to the offshore launch site.
Figure 3:
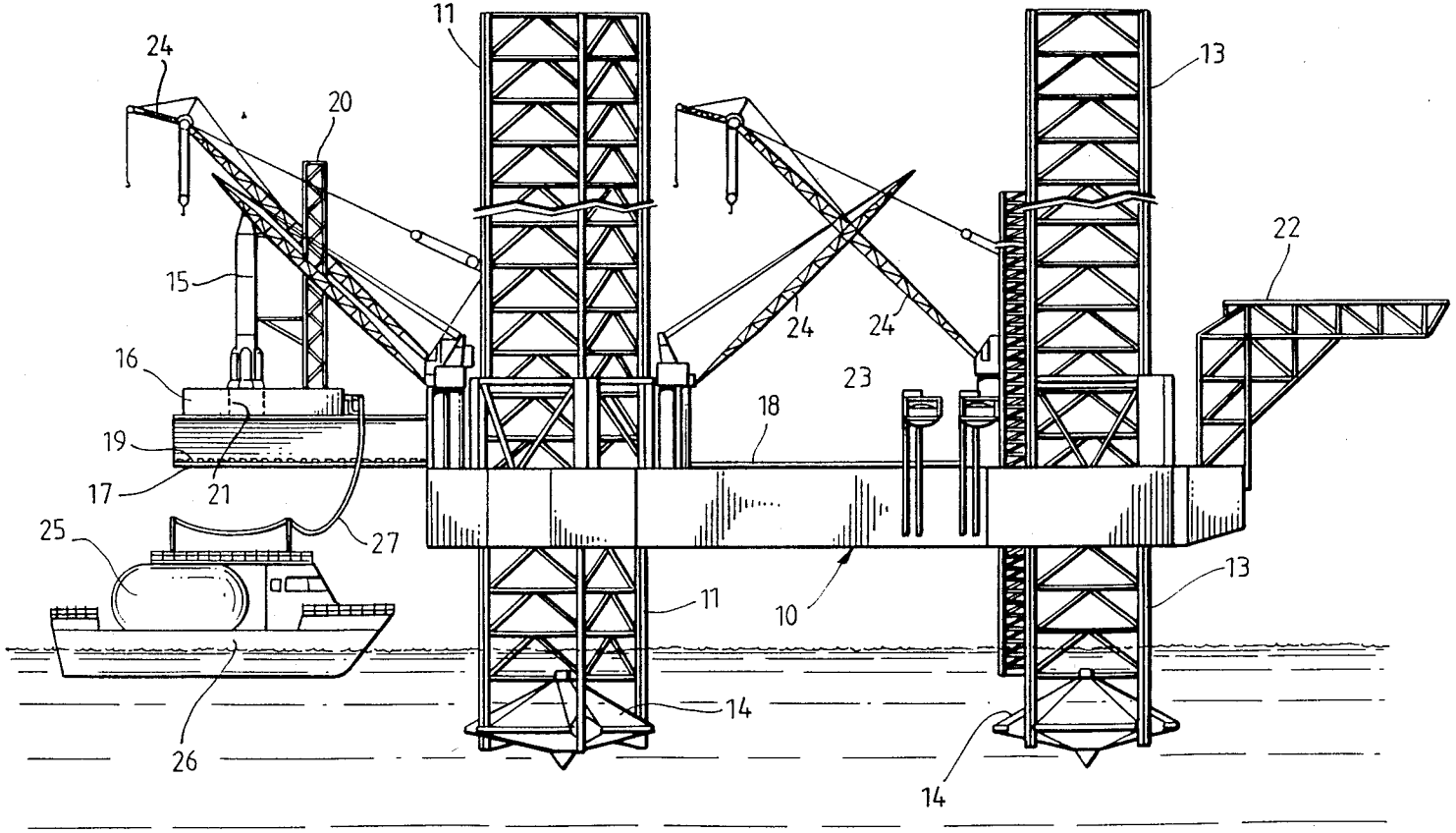
FIG. 3 is a side elevation view of the system of FIGS. 1 and 2 in the jacked-up condition with the rocket in the cantilevered position as when preparing for a launch.

According to this embodiment of the invention, the rig of FIGS. 1, 2 and 3 is adapted for launching a rocket 15 which is assembled upon a movable pad 16, also referred to as a "mobile launch platform". The pad 16 and the rocket 15 are supported by two large I-beams 17 laterally movable between a cantilevered position as illustrated in the launch condition of FIGS. 1 or 3 and a central position as seen in FIG. 2 during transport when the hull is in the water. These I-beams 17 are capable of supporting a load of perhaps 3000 tons or more; again, the size selected would depend upon the size of rocket to be launched. The rocket 15, if of the liquid fuel type, would be much lighter in weight until fueled, so even if the fueled rocket would be too heavy to be moved outboard by the cantilever mechanism, still the much-lighter unfueled rocket could be loaded onto the cantilevered pad in the on-shore assembly building then moved inboard for transport and launched from an inboard or central location. For example, a very large rocket vehicle may weight six million pounds when fully fueled, but only one-half million pounds without fuel; it may be preferable to load this vehicle in the cantilevered position then launch from a central (inboard) position on the barge. As seen in the top view of FIG. 2 and elevation view of FIG. 3, the cantilever arrangement is implemented by use of large tracks 18 slidably engaged by the I-beams 17, with electrically-operated rack-and-pinion mechanisms 19 at the lower rail of each I-beam for moving the I-beams 17 and associated pad 16 inward and outward. A gantry or support tower (also referred to as an umbilical tower) 20 is shown mounted upon the movable pad 16, and thus supported by the I-beams 17 and movable therewith, although maintained in a fixed position relative to the rocket 15; some rockets may not need this gantry, but some may use it for prelaunch support. It may be preferable to be able to move the rocket 15 as much as about 100 feet outboard of the hull 10 to avoid damage to the vessel by the rocket blast upon launch, and so this cantilever arrangement can be sized accordingly. An important feature is that the size and type of the pad 16 can be varied to fit the rocket being launched, without changing the remaining structure such as the I-beams 17, the moving mechanism 19 and the barge 10 and jack-up legs; thus the launching platform is of universal utility rather than being constructed uniquely for one particular rocket.

An important feature is that of being able to provide a free path for the exhaust plume from the rocket engine. For this purpose an opening 21 is provided, extending through the movable pad 16 to the waterline. If inboard launch is implemented, then of course the opening 21 would extend through the hull 10, or the hull would have a cutaway portion on this side of the structure. Another feature of the invention, in this regard, is that of being able to launch with as much as one or two hundred feet or more of free space beneath the lower end of the rocket engines; this is an advantage because of the back pressure and acoustic effect occurring in the early part of the launch, from the time of the ignition of the rocket engines until the rocket has lifted away from the launch pad. Using the dimensions of the counterpart oil-drilling rig mentioned above, there would be about 110 feet of free space below the output ports of the rocket engines, at minimum; the jack-up operation always leaves about 50-feet between the bottom of the hull 10 and the waterline to be clear of the seas and to allow workboats beneath the hull, the hull itself is about 30-feet height, and the depth of the I-beams 17 and pad 16 add another 30-feet. As another example, if the launching platform of FIGS. 1, 2 and 3 is jacked up in water depth of perhaps 300 feet, the legs 11, 12 and 13 can, if moved downward near their full height, lift the hull 10 to an elevation allowing the engine exhaust ports of the rocket 15 to be 200 or 300 feet, or even up to 400 feet, from the waterline at this depth the system would operate in virtually any location off Florida's east coast, and many offshore California locations. Coupled with the cantilevered position and the provision of the opening 21, this arrangement provides launch conditions even more favorable than available in land-based launch pads.

The offshore rig of FIGS. 1, 2 and 3 is of sufficient size that a helicopter landing pad 22 can be provided for facilitating transport of personnel and equipment between shore and launch site. Usually the crew is evacuated by vessel or helicopter before launch so the rig of FIG. 1 is uninhabited when the rocket engines are fired, corresponding to the safety practices of on-shore launch where the launch pad area is evacuated for a space of perhaps a mile or two. Emergency escape pods 23 are provided for evacuating the crew in case of fire or weather; these pods are circular, covered rafts which may be lowered by cable into the water from the main deck level after personnel have entered. The hull 10 has three decks, the main (upper) deck on which the cantilever mechanism is positioned and cranes 24 are provided for moving equipment and supplies, a machinery deck where there are mounted six diesel engines each driving a 1,000 KW AC generator, and a third deck (lowest) for crew quarters. Tanks for holding fuel for the rocket may be mounted on board, for example below the helicopter pad 22 remote from the personnel, or, preferably, the rocket may be fueled from tank 25 on a barge or vessel 26 separate from the hull 10 as seen in FIG. 3; this vessel 25 is propelled independent of the rig of FIGS. 1, 2 and 3 and moored to the hull 10 only while fueling the rocket after the launch site is reached and the hull is jacked up. The later method of fueling is consistent with the methods developed for on-shore launches, where the fuel, usually liquid oxygen and liquid hydrogen, is transported by barge to a location near the launch site and offloaded using flexible vacuum-jacketed (i.e., cryogenic) hoses 27. If toxic fuels are used instead of liquid oxygen and liquid hydrogen, then the advantages of this offshore launch system are even more apparent. Although liquid fuels are mentioned, it is understood that the system herein described can be used as well for launching solid-fuel rockets.

Figure 4:
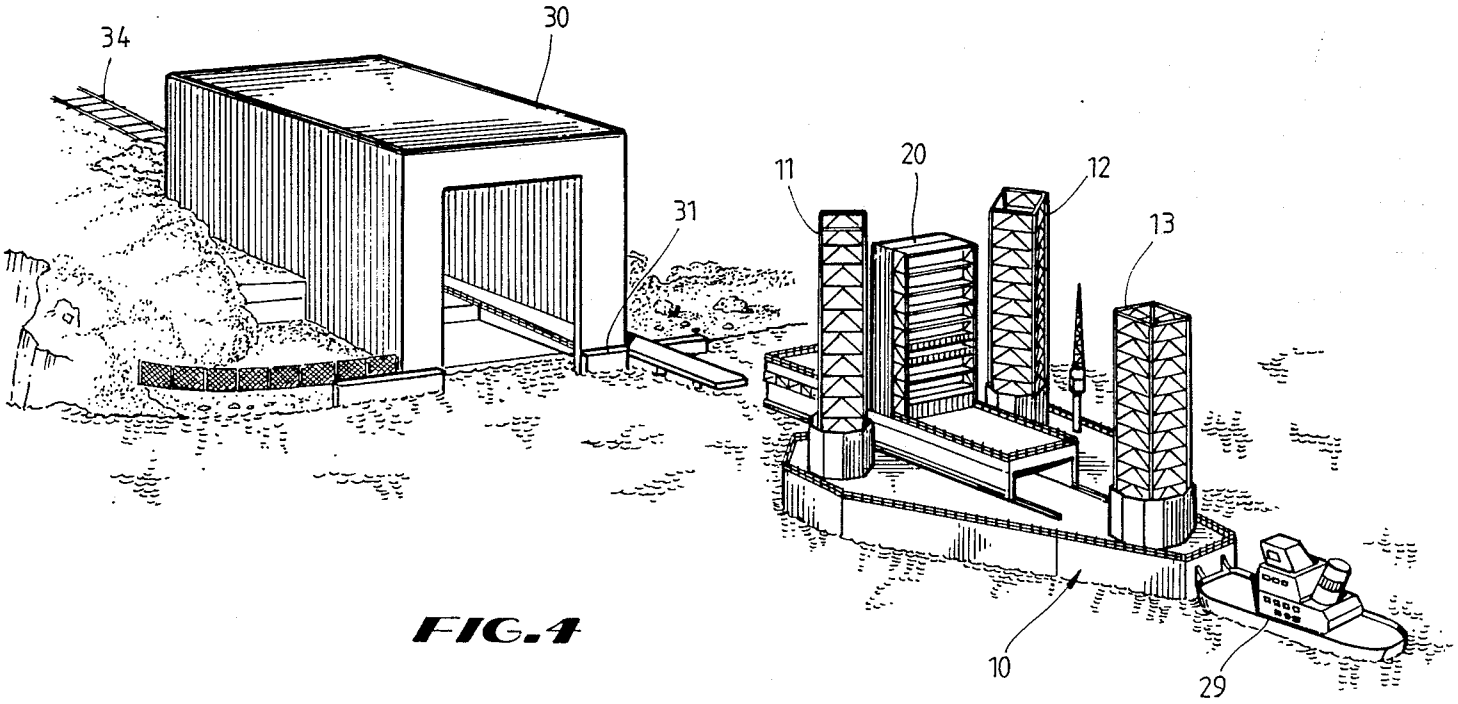
FIG. 4 is a pictorial view of the system of FIGS. 1–3 in the floating condition as when the rocket is to be loaded onto the barge at a quay.
Figure 5:
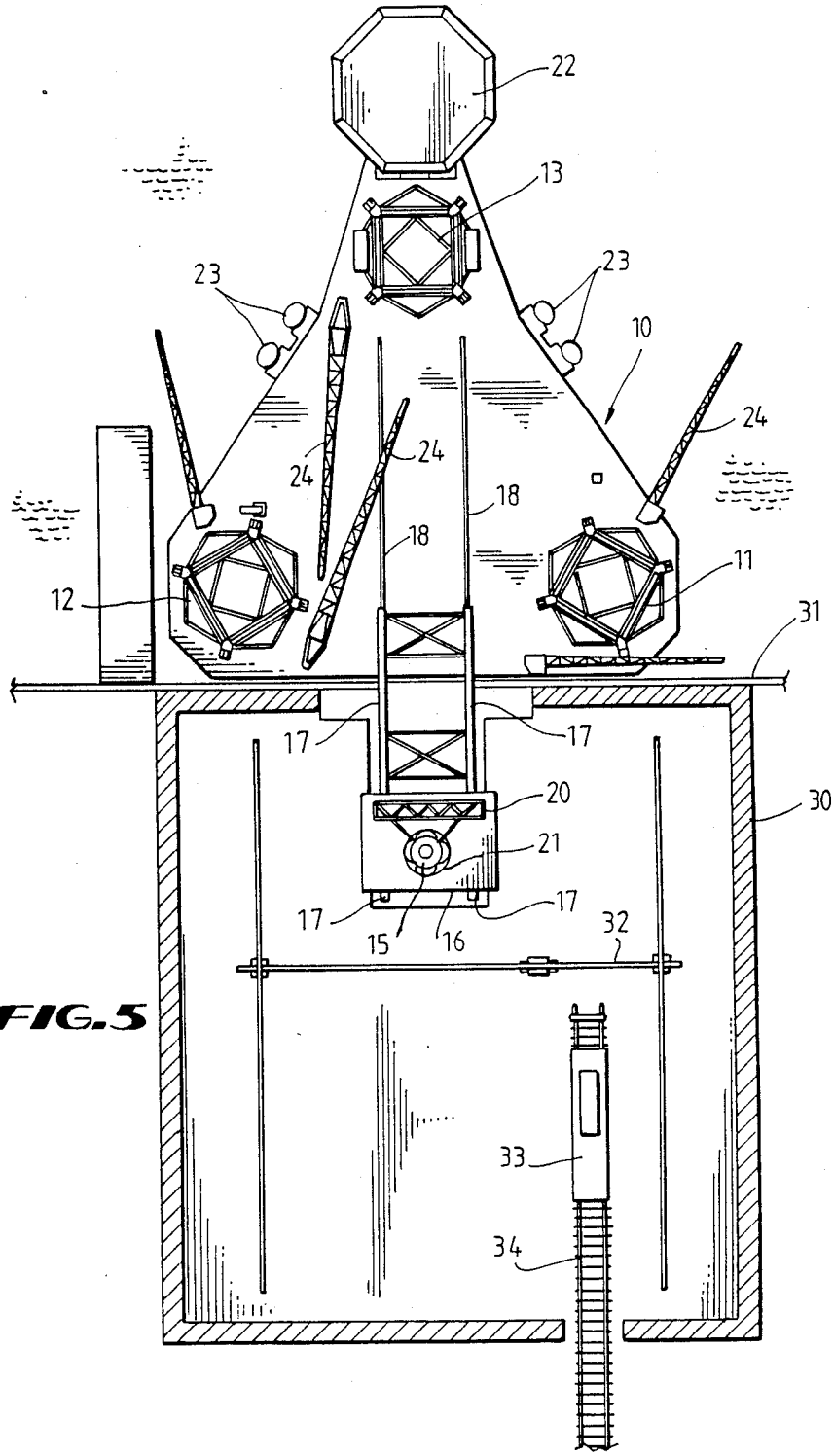
FIG. 5 is a top view of the system of FIGS. 1–4 with the cantilever rocket-mounting structure extending into the shore-based rocket-assembly building.
Figure 6:
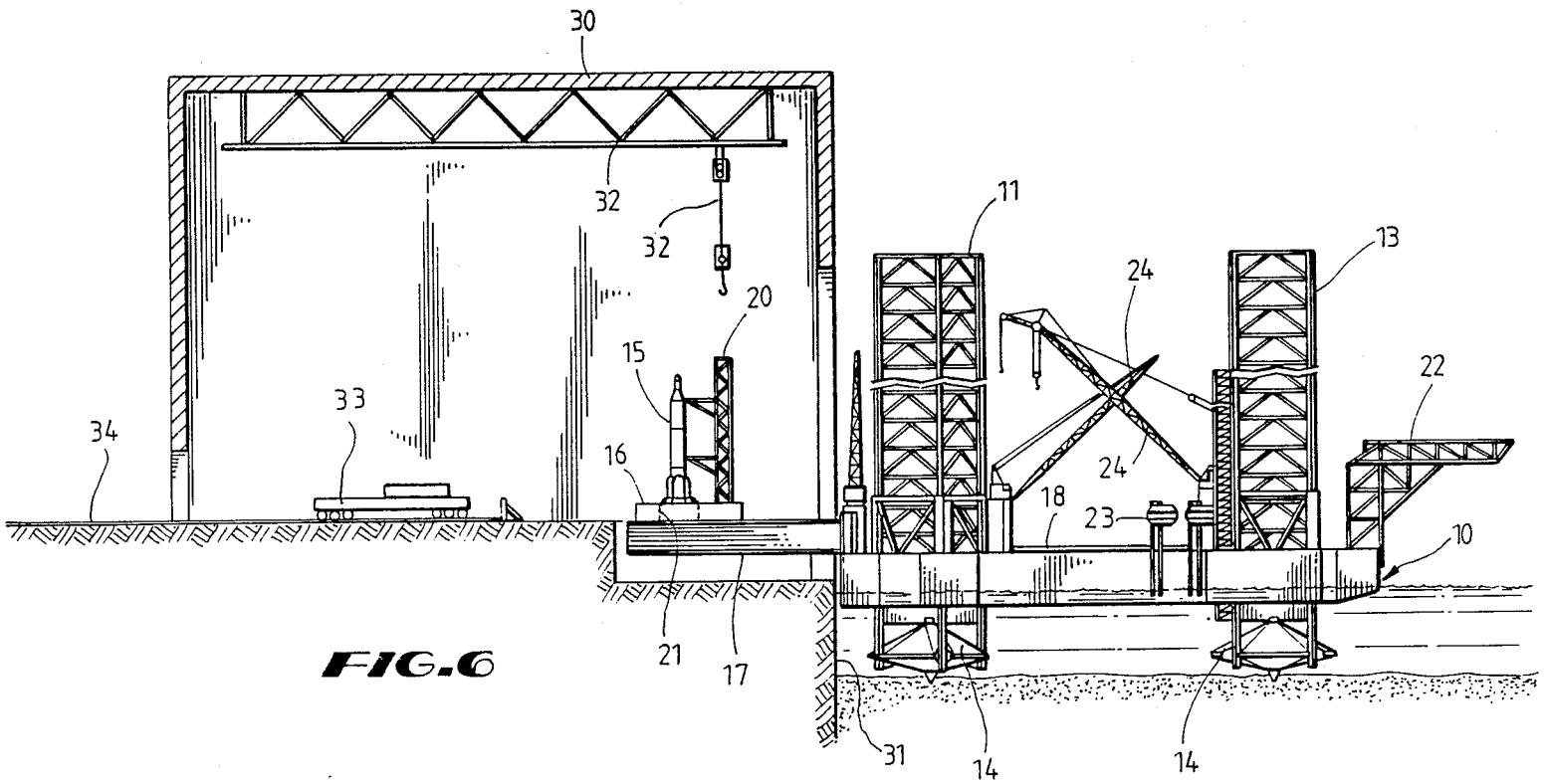
FIG. 6 is a side view of the assembly building of FIGS. 4 and 5 with the jack-up barge of FIGS. 1–4 in place for loading the rocket and movable pad onto the cantilever structure.

Referring now to FIG. 4, the rig of FIGS. 1, 2 and 3 is shown in the floating condition, propelled by a tug 29, with the legs 11, 12 and 13 in their highest position. The rig is being moved into engagement with an assembly building 30 where the rocket 15 and pad 16 (along with the gantry 20 if needed) are to be installed. The assembly building 30 is seen in a cutaway plan and elevation views in FIGS. 5 and 6, with the rig of FIG. 1 in the position where the rocket 15 and pad 16 are being installed on the cantilever mechanism, with the I-beams 17 in the fully-extended position. The building 30 is of course on land, but at water's edge so that the rig can be floated up to a dock area 31 where the water depth is adequate for floating the hull 10 with the legs in their uppermost position. As seen in FIG. 6, the legs 11, 12 and 13 are lowered so that the spuds 14 engage the bottom after the hull is tied up securely to the dockside 31. In a preferred embodiment, the rocket 15 can be assembled in the building 30 on the mobile pad 16 before the barge 10 is brought in to shore, then the I-beams 17 moved into place underneath the pad 16, after which the legs 11, 12 and 13 are lowered to raise the I-beams 17 to lift the pad 16 and assembled rocket 15 and gantry 20. The operation may be thought of as similar to that of a fork-lift; the system of FIGS. 1–6 functions to pick up the assembled pad and rocket, move it inboard, float it to an offshore launch site, move it back outboard, then launch. Thus, in the view as seen in FIG. 6, sufficient freeboard is provided beneath the pad 16 to allow the cantilevered I-beams 17 to be moved into place before the barge is jacked up. It is important that the pad 16 is in a stable, fixed condition for assembling the flight vehicle 15, and that no transfer of the assembled rocket vehicle and its pad from one unstable floating vessel to another, or from a floating vessel to a fixed platform, be necessary; thus, one of the advantages of this invention is the ability to assemble the flight in protected, stable, fixed conditions, then disturb the flight a very minimum amount during transport to the launch site. Although it may be more efficient in scheduling to assemble the rocket on the pad 16 before the barge 10 is brought in to pick it up, it is also possible to assemble the rocket on the pad 16 after the pad is in place on the I-beams 17. If an assembled rocket and pad are already in place in the building 30 when the barge 10 is brought in, but the barge already has a pad 16 still in place on the beams 17 from a previous launch, the used pad 16 is moved out of the way by a crane before moving the I-beams underneath the new rocket and pad 16. The handling and assembly building 30 houses suitable equipment such as an overhead crane 32 for moving and lifting the component parts of the flight, such as the rocket engines, boosters, payload and the like. These component parts can be brought to the handling and assembly building 30 by rail cars 33 on rails 34, or by barge which would be brought to the dock 31 at times when the hull 10 is not in place. If recoverable boosters are employed, these boosters can be brought in by vessel from downrange of the launch site and offloaded into this building 30 at the dock area 31 for reconditioning before reuse.

While the invention has been described with reference to a specific embodiment, the description is not meant to be construed in a limiting sense. Various modifications of the disclosed embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. A rocket launch system comprising:

a jack-up platform for loading a rocket from a land-based dock-side rocket-loading location while said platform is in a jacked-up bottom-supported condition and then for transporting said rocket in substantially launch-ready form from said rocket-loading location to an offshore launch site while said platform is in a floating condition, where the platform is convertible from a floating barge condition to a fixed sea-bottom-supported stable launch structure when at said launch site, the jack-up platform including a movable rocket-launching structure which is moved from a central position during said floating barge condition to a cantilevered position at either said rocket-loading location or at said launch site, and including a detachable rocket-support pad on said rocket-launching structure.

2. A system according to claim 1 wherein said movable rocket-launching structure includes a vertical gantry.

3. A system according to claim 1 including at least one floating fuel transport vessel, and wherein said platform includes fuel-conveying facilities for connecting a fuel outlet above said platform to a location below said platform for coupling to said floating fuel transport vessel when said platform is at said launch site.

4. A system according to claim 1 wherein said movable launching structure includes a movable rocket-support pad on which said rocket is assembled while at said rocket-loading location.

5. A system according to claim 4 wherein said rocket-support pad has an opening below the position of the rocket when in said cantilevered position to provide free space for an exhaust plume during launch of the rocket.

6. A rocket launch system comprising:

a jack-up platform for transporting a rocket in substantially launch-ready form from a land-based dock-side rocket-loading location to an offshore launch site, where the platform is convertible from a floating barge condition to a fixed sea-bottom-supported stable launch structure when at said launch site, the jack-up platform including a movable launching structure which is moved from a central position during said floating barge condition to a cantilevered position at either said loading location or at said launch site, and including a shore-based delivery system for rockets which are to be loaded upon said platform while in said loading location, said delivery system including a rocket assembly and loading structure located at said loading location and surrounding said rocket while in said cantilevered position.

7. A method for offshore launching of missiles, comprising the steps of:

(a) loading a missile onto a cantilevered structure of a floating barge from a dock-side missile assembly building;

(b) moving said cantilevered structure from a position spaced from an edge of said barge to a central position on said barge;

(c) propelling the barge from said dock-side location to an offshore missile launch location;

(d) extending jack-up legs from said barge to ocean bottom to raise the barge to an above-water position and to secure the barge in a fixed position;

(e) moving said cantilever structure to said cantilevered position with the missile still in the same position where mounted from said assembly building;

(f) and launching said missile from said cantilevered structure, exhaust from said missile during said launch being directed downwardly through an exhaust opening in the lower part of said cantilever structure to an area clear of said barge.

8. A method according to claim 7 including the step of extending said jack-up legs prior to said step of loading the missile in order to hold said barge and cantilevered structure in a fixed position during said step of loading, then retracting said jack-up legs prior to said step of propelling.

9. A method according to claim 7 wherein said step of loading includes assembling said missile from component parts on a movable pad then picking up said pad and missile on said cantilevered structure.

10. A method according to claim 7 wherein said missile is maintained in a vertical position on a missile-support pad during said steps of loading, propelling, moving and launching.

11. A method according to claim 8 including the step of loading fuel into said missile from a vessel separate from said barge when said barge is at said offshore launch location.

12. A method of offshore launching of rocket vehicles or the like, comprising the steps of:

(a) loading an assembled rocket vehicle and support structure for the rocket vehicle onto a floating barge from a on-shore rocket handling and assembly structure;

(b) propelling the barge away from said rocket handling and assembly structure and to an offshore rocket launch location;

(c) extending jack-up legs from said barge to ocean bottom to raise the barge to an above-water position and to secure the barge in a fixed position;

(d) and launching said rocket vehicle into space from said support structure, exhaust from said rocket vehicle during said launch being directed downwardly through an exhaust opening in the lower part of said support structure.

13. A method according to claim 12 wherein said rocket vehicle is maintained in a vertical position on a movable rocket-support pad during said steps of loading, propelling, and launching.

14. A method according to claim 12 wherein said step of launching includes directing the exhaust plume from the rocket vehicle through an opening in said support structure downward to the waterline.

15. A method according to claim 12 wherein said rocket is positioned upon a movable rocket-support pad during said steps of loading, propelling and launching, and wherein said pad is of variable size depending upon the size and type of rocket being launched.

16. A method according to claim 12 including the step of loading fuel into said rocket vehicle from a vessel separate from said barge when said barge is at said offshore launch location.

17. A method according to claim 16 wherein said rocket vehicle and support structure are positioned onto a cantilevered structure during said step of loading.

18. A method according to claim 17 wherein said cantilevered structure is moved to a position over said barge during said step of transporting.

19. A method according to claim 18 wherein said cantilevered structure is moved to a cantilevered position spaced from said barge during said step of launching.

20. A method according to claim 19 wherein said barge is jacked up to secure said barge in a fixed position during said step of loading.

21. A method of offshore launching of rocket vehicles or the like, comprising the steps of:

(a) loading a rocket vehicle onto a floating barge from an on-shore structure;

(b) propelling the floating barge away from said structure and to an offshore rocket launch location;

(c) extending jack-up legs from said barge to ocean bottom to raise the barge to an above-water position and to secure the barge in a fixed position;

(d) and thereafter launching said rocket vehicle from said barge.

22. A method according to claim 21 wherein said rocket vehicle is maintained in a vertical position on a movable rocket-support pad during said steps of loading, propelling, and launching.

23. A method according to claim 21 including the step of loading fuel into said rocket vehicle from a vessel separate from said barge when said barge is at said offshore launch location.

24. A method according to claim 21 wherein said barge is jacked up to secure said barge in a fixed position during said step of loading.

25. A method according to claim 21 wherein said step of launching includes directing the exhaust plume from the rocket vehicle through an opening in said support structure downward to the waterline.

26. A method of offshore launching of rocket vehicles or the like, comprising the steps of:

(a) loading a rocket vehicle onto a floating barge from an on-shore structure, wherein said rocket vehicle is positioned onto a cantilevered structure during said step of loading;

(b) propelling the floating barge away from said on-shore structure and to an offshore rocket launch location;

(c) extending jack-up legs from said barge to ocean bottom to raise the barge to an above-water position and to secure the barge in a fixed position;

(d) and thereafter launching said rocket vehicle from said barge.

27. A method according to claim 26 wherein said cantilevered structure is moved to a position over said barge during said step of transporting.

28. A method according to claim 26 wherein said cantilevered structure is moved to a cantilevered position spaced from said barge during said step of launching.

* * * * *